US010024310B2

(12) United States Patent
Pendleton

(10) Patent No.: US 10,024,310 B2
(45) Date of Patent: Jul. 17, 2018

(54) MODULAR PUMP DESIGN

(75) Inventor: Gary Pendleton, Spring, TX (US)

(73) Assignee: AFGLOBAL CORPORATION, Houston, TX (US)

( * ) Notice: Subject to any disclaimer, the term of this patent is extended or adjusted under 35 U.S.C. 154(b) by 892 days.

(21) Appl. No.: 13/342,657

(22) Filed: Jan. 3, 2012

(65) Prior Publication Data

US 2012/0272764 A1 Nov. 1, 2012

Related U.S. Application Data

(60) Provisional application No. 61/480,242, filed on Apr. 28, 2011.

(51) Int. Cl.

| | |
|---|---|
| ***F04B 9/02*** | (2006.01) |
| ***F04B 53/00*** | (2006.01) |
| ***F04B 15/02*** | (2006.01) |

(52) U.S. Cl.

CPC ..... *F04B 9/02* (2013.01); *F04B 15/02* (2013.01); *F04B 53/006* (2013.01); *Y10T 29/49236* (2015.01); *Y10T 74/19642* (2015.01); *Y10T 74/19651* (2015.01); *Y10T 74/19828* (2015.01)

(58) Field of Classification Search

CPC .. F04C 2240/70; F04C 15/0061; F16H 57/02; F04B 9/02; F04B 23/04; F04B 23/06; F04B 23/08; F04B 23/10; F04B 23/12; F04B 231/14; F04B 35/01; F04B 39/14; F04B 41/06; F04B 53/22; F04D 25/16; F04D 25/163; F04D 13/12; F04D 29/60

USPC ..... 92/136; 74/89.28, 665 R, 63, 405, 665 F, 74/665 K

See application file for complete search history.

(56) References Cited

U.S. PATENT DOCUMENTS

| | | | | |
|---|---|---|---|---|
| 2,666,335 | A | | 1/1954 | Clayborne |
| 2,883,874 | A | | 4/1959 | Bynum |
| 3,800,626 | A | * | 4/1974 | Koivunen ..... 475/71 |
| 3,988,950 | A | * | 11/1976 | Mori ..... 74/665 K |
| 4,194,586 | A | * | 3/1980 | Hicks ..... 180/24.09 |
| 4,261,218 | A | | 4/1981 | Eagan |
| 4,293,290 | A | * | 10/1981 | Swanson ..... 418/94 |
| 4,453,901 | A | * | 6/1984 | Zimmerly ..... 418/206.1 |
| 4,621,994 | A | * | 11/1986 | Ellis ..... 418/206.1 |
| 4,651,435 | A | * | 3/1987 | Wettstein ..... 33/536 |
| 4,730,992 | A | * | 3/1988 | Ogawa ..... F04B 7/045 417/365 |
| 5,003,772 | A | * | 4/1991 | Huber ..... 60/259 |
| 5,096,396 | A | * | 3/1992 | Welch ..... 418/39 |
| 5,127,281 | A | * | 7/1992 | Yanawgisawa ..... 74/89.28 |
| 5,138,764 | A | * | 8/1992 | Breda et al. ..... 29/890.039 |
| 5,282,762 | A | * | 2/1994 | Cerreto ..... 440/30 |

(Continued)

FOREIGN PATENT DOCUMENTS

| | | |
|---|---|---|
| DE | 19849785 C1 | 3/2000 |
| EP | 2458210 A1 | 5/2012 |

OTHER PUBLICATIONS

Extended European Search Report in related EP Application No. 12776777.0, dated Jul. 10, 2015 (7 pages).

(Continued)

*Primary Examiner* — William J Kelleher
*Assistant Examiner* — Gregory T Prather
(74) *Attorney, Agent, or Firm* — Basil M. Angelo; Angelo Mikeska PLLC

(57) ABSTRACT

Modular pumps comprising universal gearboxes and crank units and associated methods.

14 Claims, 14 Drawing Sheets

(56) References Cited

U.S. PATENT DOCUMENTS 5,386,742 A * 2/1995 Irikura et al. ..... 74/665 F
5,735,765 A * 4/1998 Teraoka et al. ..... 475/248
5,847,519 A * 12/1998 Kilker ..... 318/14
6,155,964 A * 12/2000 Hensley ..... 494/9
6,283,740 B1 * 9/2001 Brown ..... 418/206.6
6,406,281 B1 * 6/2002 Aggradi et al. ..... 418/88
6,428,443 B1 * 8/2002 Dischler ..... 475/343
6,666,666 B1 * 12/2003 Gilbert et al. ..... 418/9
6,676,560 B1 * 1/2004 Buelna ..... 476/51
8,251,603 B2 * 8/2012 Kott et al. ..... 401/48
8,365,637 B2 * 2/2013 Herold et al. ..... 74/665 GA
8,480,529 B2 * 7/2013 Pohl et al. ..... 475/186
8,821,141 B2 * 9/2014 Helgeson et al. ..... 418/104
8,992,193 B2 * 3/2015 Walgren et al. ..... 418/102
2001/0014277 A1 * 8/2001 Braud ..... 414/680
2003/0213324 A1 11/2003 Eberle
2004/0020325 A1 * 2/2004 Krzesicki et al. ..... 74/650
2005/0254970 A1 * 11/2005 Mayer ..... F04C 2/086 417/410.4
2007/0154256 A1 7/2007 Finocchio
2008/0069707 A1 * 3/2008 Van Norman et al. .... 417/410.1
2009/0066322 A1 * 3/2009 Shintani et al. ..... 324/207.24
2009/0304540 A1 * 12/2009 Whittome et al. ..... 418/104
2010/0107456 A1 * 5/2010 Miller et al. ..... 37/468
2010/0116375 A1 * 5/2010 Eginton ..... B65B 57/145 141/9
2010/0319363 A1 * 12/2010 Dieckmann ..... 62/56
2012/0018168 A1 * 1/2012 Denny ..... E21B 43/128 166/369
2012/0073890 A1 * 3/2012 Bindl et al. ..... 180/69.6
2013/0081513 A1 * 4/2013 Ternovetsky et al. ..... 74/665 Q
2013/0098201 A1 * 4/2013 Suzuki et al. ..... 74/665 F
2013/0119793 A1 * 5/2013 Hofkirchner et al. ..... 310/54
2013/0202468 A1 * 8/2013 Patterson et al. ..... 418/1
2014/0027239 A1 * 1/2014 Bibby ..... 192/203
2014/0087889 A1 * 3/2014 Mahe ..... 464/68.9
2014/0246263 A1 * 9/2014 Strenge ..... 180/374
2014/0260721 A1 * 9/2014 Hoefken ..... 74/55
2015/0087429 A1 * 3/2015 Verhoog et al. ..... 464/68.1

OTHER PUBLICATIONS

Office Action issued in related Chinese patent appln. No. 201280020861.5, dated Dec. 18, 2015 (24 pages with translation).

* cited by examiner

MODULAR PUMP DESIGN

CROSS-REFERENCE TO RELATED APPLICATIONS

This application claims the benefit of U.S. Provisional Patent Application Ser. No. 61/480,242, filed on Apr. 28, 2011, the entire disclosure of which is hereby incorporated by reference.

BACKGROUND

Reciprocating pumps are used extensively throughout the oil and gas industry. These types of pumps are commonly used as mud pumps and fracturing pumps. These pumps are capable of delivering fluids and other various media to the application process at various flow rates and pressures.

Reciprocating pumps come in a variety of sizes and configurations. For example, reciprocating pumps may be configured in triplex, quadruplex, and quintuplex configurations. The power output of the pumps can range from 300 horsepower to in excess of 2500 horsepower. The specific configuration of the pumps is often designed to suit the particular application requirements.

Reciprocating pumps are typically manufactured to order and, as a result, may take several months to manufacture and deliver. Reciprocating pumps are generally constructed with left-hand or right-hand drive mechanisms with the casing being specific to each application. This impacts the type of drive which can be employed in the pump. For example, worm drive pumps have their driveline at 90 degrees to the axial crank orientation and pinion drive pumps and planetary gears installations have their drivelines parallel to the axial crank orientation. Consequently, pumps are generally constructed to a specification, specific for the application, making the construction process severely restricted by configuration requirements.

There is a need for an improved process of manufacturing reciprocating pumps.

SUMMARY

The present invention relates to a modular pump design. More particularly, the present invention relates to a modular pump design comprising universal components and associated methods.

In one embodiment, the present invention provides a modular pump comprising a universal gearbox and a crank unit, wherein the crank unit is attached to the universal gearbox.

In another embodiment, the present invention provides a universal gearbox for use in a reciprocating pump.

In another embodiment, the present invention provides a method of assembling a reciprocating pump comprising: providing a universal gearbox; providing one or more crank units; and attaching the one or more crank units to the universal gearbox.

The features and advantages of the present invention will be readily apparent to those skilled in the art. While numerous changes may be made by those skilled in the art, such changes are within the spirit of the invention.

BRIEF DESCRIPTION OF THE DRAWINGS

A more complete and thorough understanding of the present embodiments and advantages thereof may be acquired by referring to the following description taken in conjunction with the accompanying drawings.

DETAILED DESCRIPTION

The present invention relates to a modular pump design. More particularly, the present invention relates to a modular pump design comprising universal components and associated methods.

There may be several potential advantages of the modular pumps and methods disclosed herein. One of the many potential advantages of the modular pumps and methods disclosed herein is that they may allow for a streamlined pump construction process. Another potential advantage of the modular pumps and methods disclosed herein is that they may provide a pump design which is adaptable to client requirements without the need for significant customization. Another potential advantage of the modular pumps and methods disclosed herein is that they may provide for multiple final pump constructions that can be achieved with fewer parts and assemblies without relying upon a specific component manufacture. Another potential advantage of the modular pumps and method disclosed herein is that the may provide a pump design that is easier to maintain. It is feasible that a universal component of the modular pump design discussed herein could be sent to a jobsite for the replacement of a damaged unit, for example, a crank unit could replaced completely with a new replacement unit at the jobsite by suitably qualified personal.

By separating the main elements of the pump into discrete assemblies, such as gearboxes and crank units, it is possible to formalize the construction approach. By providing gearboxes and crank units which are "universal," the construction approach to pump assembly can be improved. As used herein, the term "universal" is used to refer to components that are not specific to a left or right hand configuration, but rather can function in right handed, left handed, and no handed configurations. By utilizing the methods discussed herein, universal pump components can be built for inventory and then simply be bolted together to meet the configuration demands of a client, reducing the lead time for delivery from months to possibly days. A main consideration of this approach is to understand how the gearboxes and the crank units can be assembled to create a specific pump configuration. The following information is a concept to achieve a streamlined pump construction process.

In certain embodiments, the present disclosure provides a modular pump comprising a gearbox and a crank unit. The modular pumps discussed herein may have any range of horsepower. In certain embodiments, the pumps discussed herein may be 500, 1000, 1500, 2000, or 2500 horsepower pumps.

Figure 1:
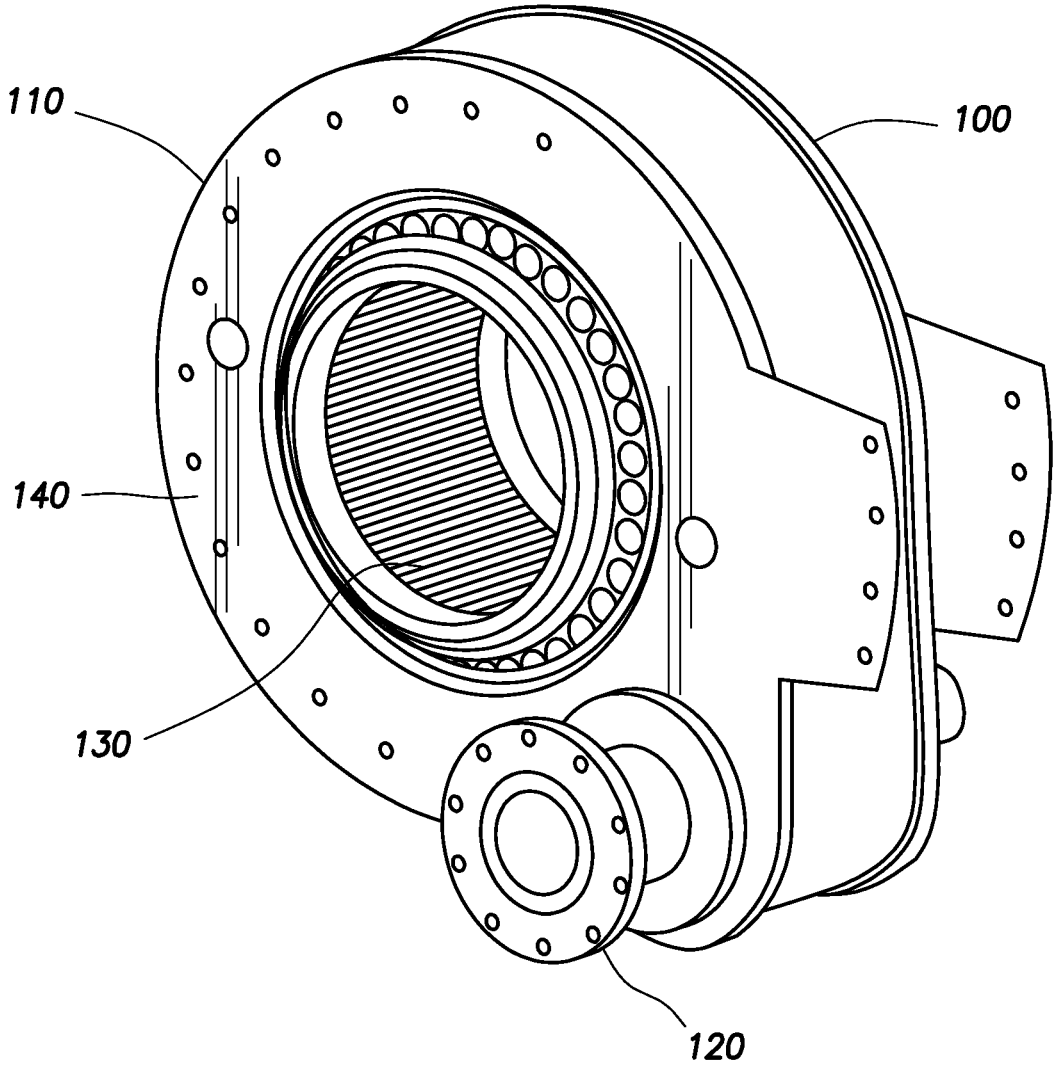
FIGS. 1 and 2 are illustrations of universal gearboxes in accordance with certain embodiments of the present disclosure.

In certain embodiments, the gearbox may be a universal gearbox. Examples of gearboxes include worm/wheel gear drives, pinion drives, and planetary drive gear systems. An example of a pinion drive gear box is illustrated in FIG. 1. An example of a worm gear drive box is illustrated in FIG. 2.

Referring now to FIG. 1, FIG. 1 illustrates a pinion drive gear box 100. In certain embodiments, pinion drive gear box 100 may comprise a housing 110, an opposed helical gear 120, a universal adapter hub 130, and one or more mounting surfaces 140. Each of the components of pinion drive gear box 100 may be constructed out of any suitable material to withstand pressures of up to 20,000 psi and temperatures up to 400° F. In some embodiments, the components of pinion drive gear box 100 may be constructed out of AISI 4140 steel, AISI 4330 steel, or derivatives thereof.

In certain embodiments, the opposed helical gear 120 may be a herringbone gear. In certain embodiments, the universal adapter hub 130 comprises a splined internal detail. In certain embodiments, the universal adapter hub 130 may be suitable for both pinion and worm drives. In certain embodiments, opposed helical gear 120 may be mechanically connected to universal adapter hub 130 such that when rotational energy is applied to helical gear 120, that rotational energy is transmitted to universal adapter hub 130 which then rotates inside the pinion drive gear box 100. Once rotating, universal adapter hub 130 may then provide drive to one or more crank units through its splined internal detail.

Figure 2:
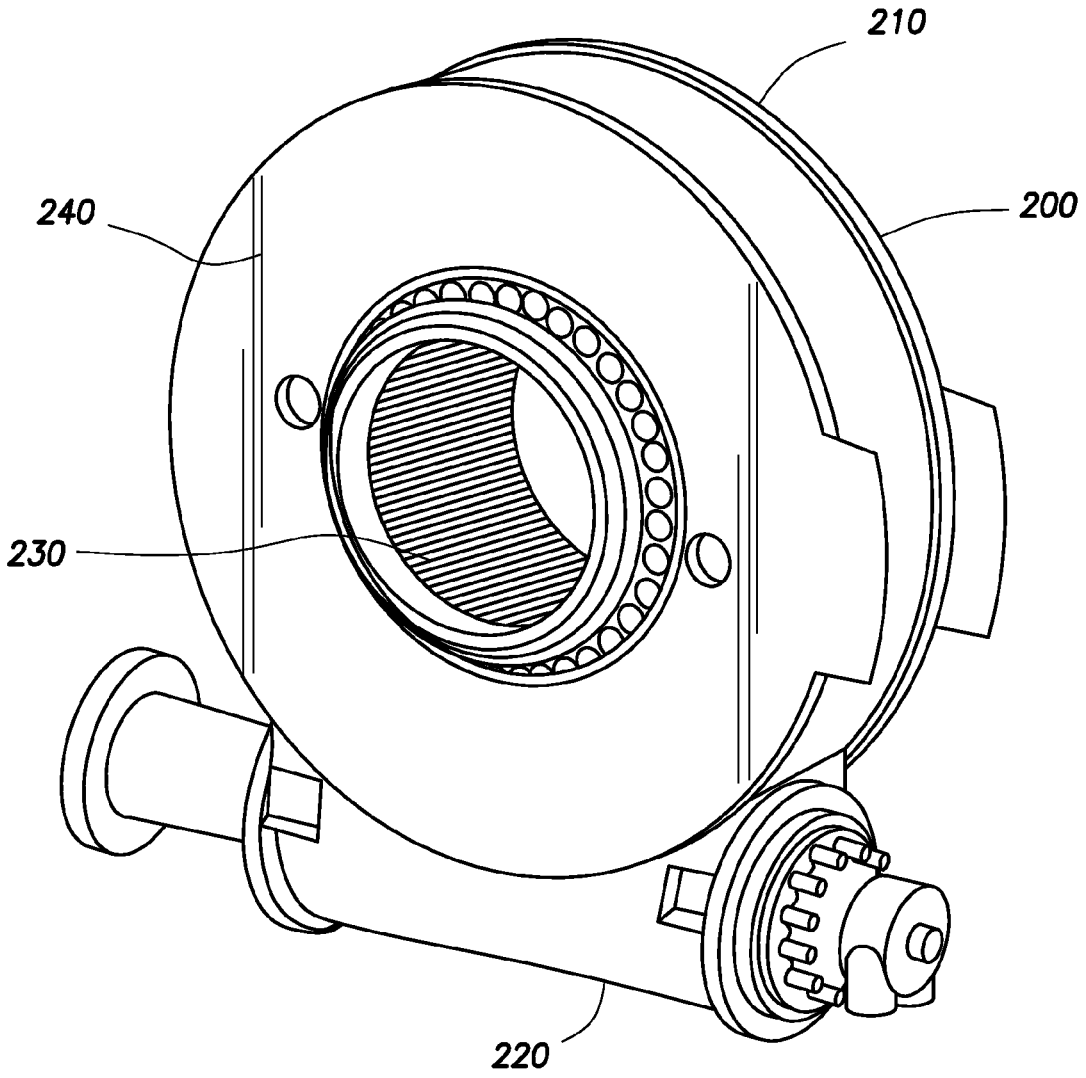

Referring now to FIG. 2, FIG. 2 illustrates a worm drive gear box 200. In certain embodiments, worm drive gear box 200 may comprise a housing 210, a worm style gear 220, a universal adapter hub 230, and one or more mounting surfaces 240. Each of the components of worm drive gear box 200 may be constructed out of any suitable material to withstand pressures of up to 20,000 psi and temperatures up to 400° F. In some embodiments, the components of worm drive gear box 200 may be constructed out of AISI 4140 steel, AISI 4330 steel, or derivatives thereof.

In certain embodiments, the universal adapter hub 230 comprises a splined internal detail. In certain embodiments, the universal adapter hub 230 may be suitable for both pinion and worm drives. In certain embodiments, worm style gear 220 may be mechanically connected to universal adapter hub 230 such that when rotational energy is applied to worm style gear 220, that rotational energy is transmitted to universal adapter hub 230 which then rotates inside the worm drive gear box 200. Once rotating, universal adapter hub 230 may then provide drive to one or more crank units through its splined internal detail.

The gearboxes discussed in the present disclosure may be universal in that one or more crank units may be attached to either side of the gearboxes without any modification of the gearbox. In other embodiments, one crank unit may be attached to one side of the gear box and a cover may be attached to the other side of the gear box. Consideration has been made to the method attaching the crank units to the gearboxes. In certain embodiments, the connection may be made via a central splined hub unit to drive the cranks, with the main crank fabricated housing attaching directly to the gearbox housing. By maintaining the same width between a worm drive and a pinion drive, it is possible to maintain the same assembly methods for the crank units.

Figure 3:
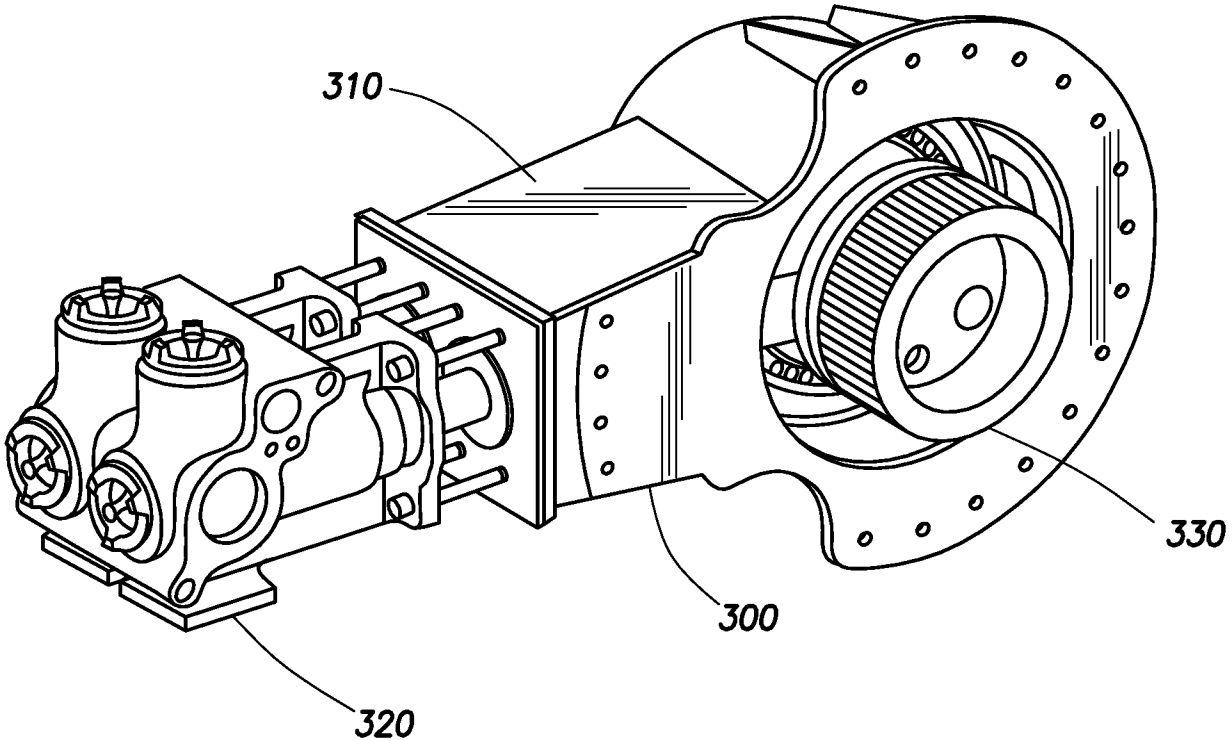
FIGS. 3 and 4 are illustrations of crank units in accordance with certain embodiments of the present disclosure.
Figure 4:
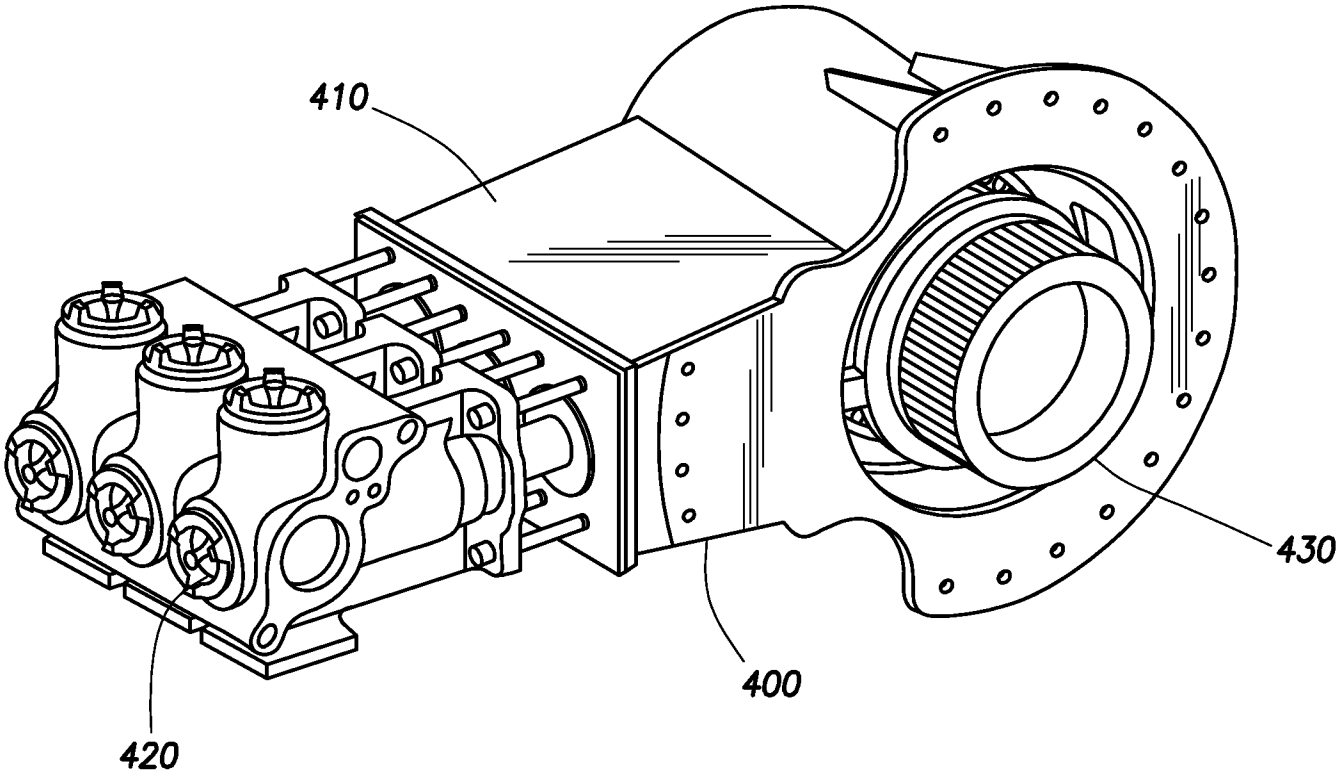

The crank unit may comprise any number of throws. In certain embodiments, the crank unit may be a three throw crank (triplex) or a five throw crank (quintuplex). In the case of the quintuplex, the arrangement may be a two+three throw crank arrangement with each crank being on either side of the gearbox. An example of a two throw crank unit is illustrated in FIG. 3. An example of a three throw crank unit is illustrated in FIG. 4.

Referring now to FIG. 3, FIG. 3 illustrates a two throw crank unit 300. The two throw crank unit 300 may comprise a housing body 310, fluid ends 320, and a central splined hub unit 330. Referring now to FIG. 4, FIG. 4 illustrates a three throw crank unit 400. The three throw crank unit 400 may comprise a housing body 410, fluid ends 420, and a central splined hub unit 430. Each of the components of two throw crank unit 300 and three throw crank unit 400 may be constructed out of any suitable material to withstand pressures of up to 20,000 psi and temperatures up to 400° F. In some embodiments, the components of two throw crank unit 300 and three throw crank unit 400 may be constructed out of AISI 4140 steel, AISI 4330 steel, or derivatives thereof.

Regardless of the number of throws, each crank unit may be made up of a housing and locating bearings (not illustrated), to which the crank may be assembled. The crank itself can have varying throw distance. In some embodiments, the throw distance may range from 6 to 12 inches. Each crank throw may be attached to a connecting rod/piston arrangement which is ultimately used in the pumping process via the fluid end units.

In certain embodiments, for example in a triplex configuration, the radial throw separation may be 120 degrees. In other embodiments, for example in a quintuplex configuration, the radial throw separation may be 72 degrees. However, in either case, the essence of the crank manufacture may be the same. By manufacturing 2 (72 or 120 degree) crank units, it is possible to utilize the same housing bearing construction elements. Making the housing a universal arrangement may result in a universal pump (albeit the pump can be configured as a left or right hand drive).

In the case of the Triplex pump, the crank unit may be simply bolted to the gearbox either on the left or the right side of the gearbox. Similarly the a quintuplex pump can be configured as left or right configuration with the 2 throw crank mounted to the opposite side of the gearbox relative to the 3 throw crank. Internal features to the crank ensure absolute crank timing.

Taking the ability to customize the construction also results in further opportunities to refine the customization. For example a quadruplex pump could be constructed using 2+2 throw crank units (the cranks being manufactured for 90 degree separation). Possibly more extreme would be a Hexaplex Pump utilizing a 3+3 configuration, subject to drive, flow rate and pressure requirements.

The separation of the gearbox also allows adaptability of the drive system to include planetary gear units (which may be limited to triplex configuration), or other means of propulsion, e.g. hydraulic motor. Consequently the customizability of the configurations is not limited to triplex or quintuplex configurations, but using the design principles multiple configurations are possible utilizing a few key elements.

In certain embodiments, the present disclosure provides a method of assembling a reciprocating pump comprising: providing a universal gearbox; providing one or more crank units; and attaching the one or more crank units to the universal gearbox. In certain embodiments, the one or more crank units may be attached to either side of the universal gearbox or both sides.

Figure 5:
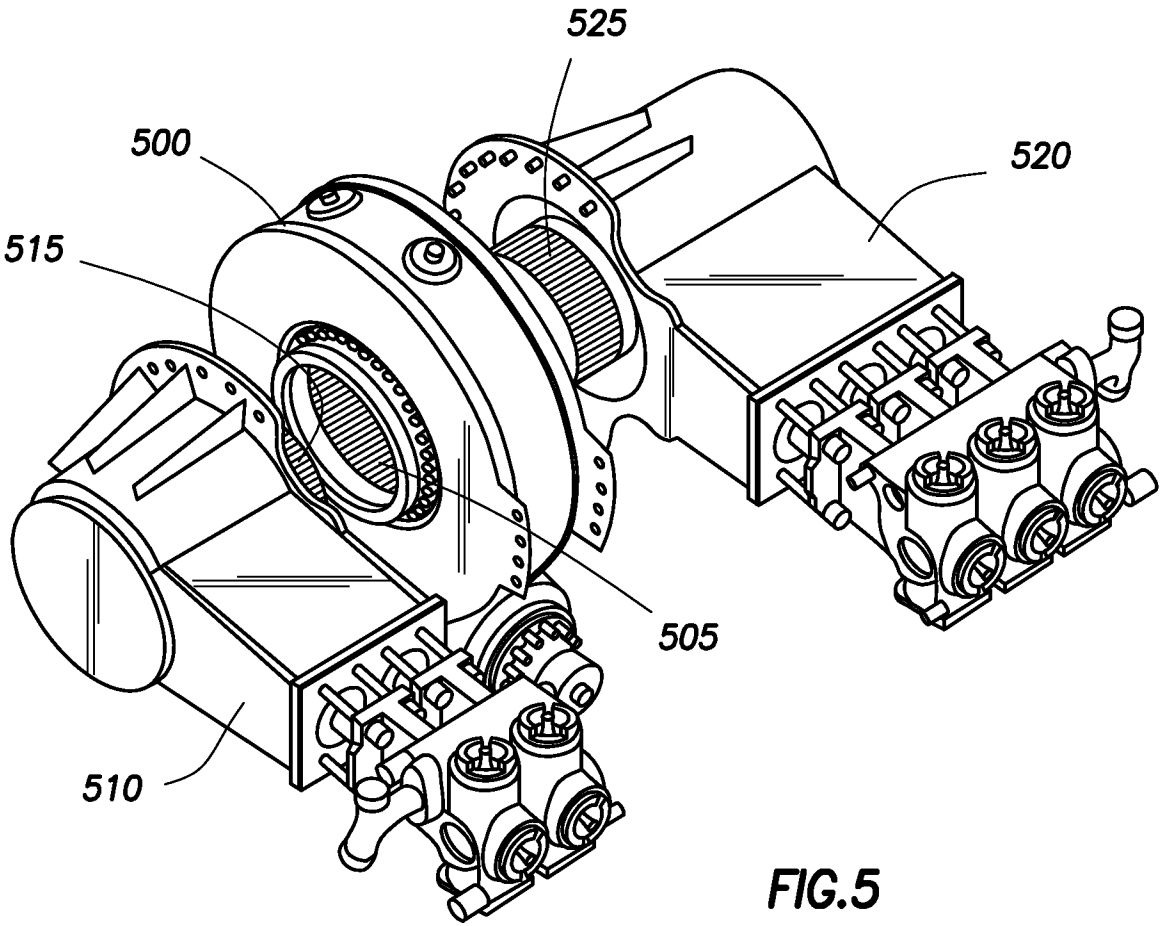
FIGS. 5 and 6 are illustrations of how reciprocating pumps in accordance with certain embodiments of the present disclosure may be assembled.
Figure 6:
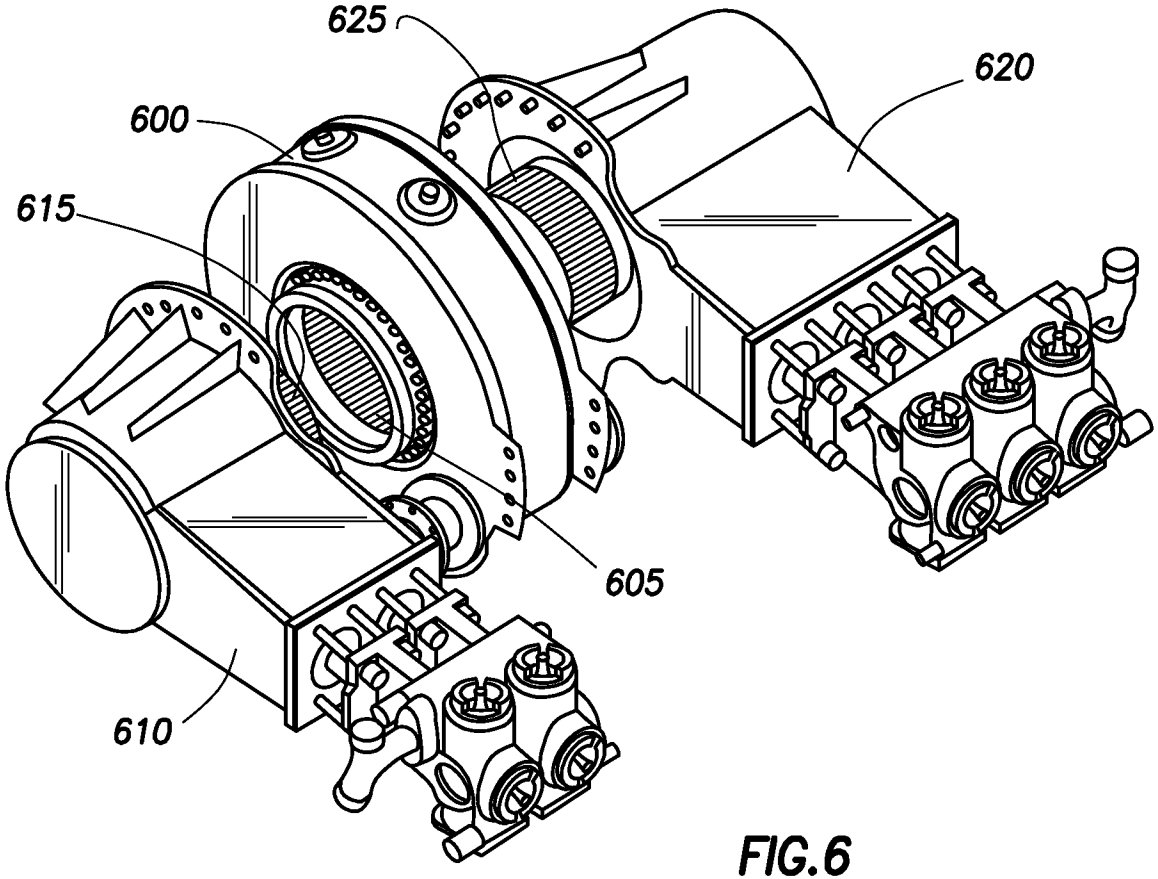

FIGS. 5 and 6 depict how in certain embodiments, the reciprocating pumps of the present disclosure may be assembled.

As illustrated in FIG. 5, two throw crank unit 510 may be slid into worm drive gear box 500 in a manner such that the central splined hub unit 515 of two throw crank unit 510 rests inside universal adapter hub 505 of worm drive gear box 500. Similarly, as also illustrated in FIG. 5, three throw crank unit 520 may be slid into worm drive gear box 500 in a manner such that the central splined hub unit 525 of three throw crank unit 520 rests inside universal adapter hub 505 of worm drive gear box 500. Once assembled in such a manner, two throw crank unit 510 and three throw crank unit 520 may then be bolted onto worm drive gear box 500.

As illustrated in FIG. 6, two throw crank unit 610 may be slid into pinion drive gear box 600 in a manner such that the central splined hub unit 615 of two throw crank unit 610 rests inside universal adapter hub 605 of pinion drive gear box 600. Similarly, as also illustrated in FIG. 6, three throw crank unit 620 may be slid into pinion drive gear box 600 in a manner such that the central splined hub unit 625 of three throw crank unit 620 rests inside universal adapter hub 605 of pinion drive gear box 600. Once assembled in such a manner, two throw crank unit 610 and three throw crank unit 620 may then be bolted onto pinion drive gear box 800.

Figure 7:
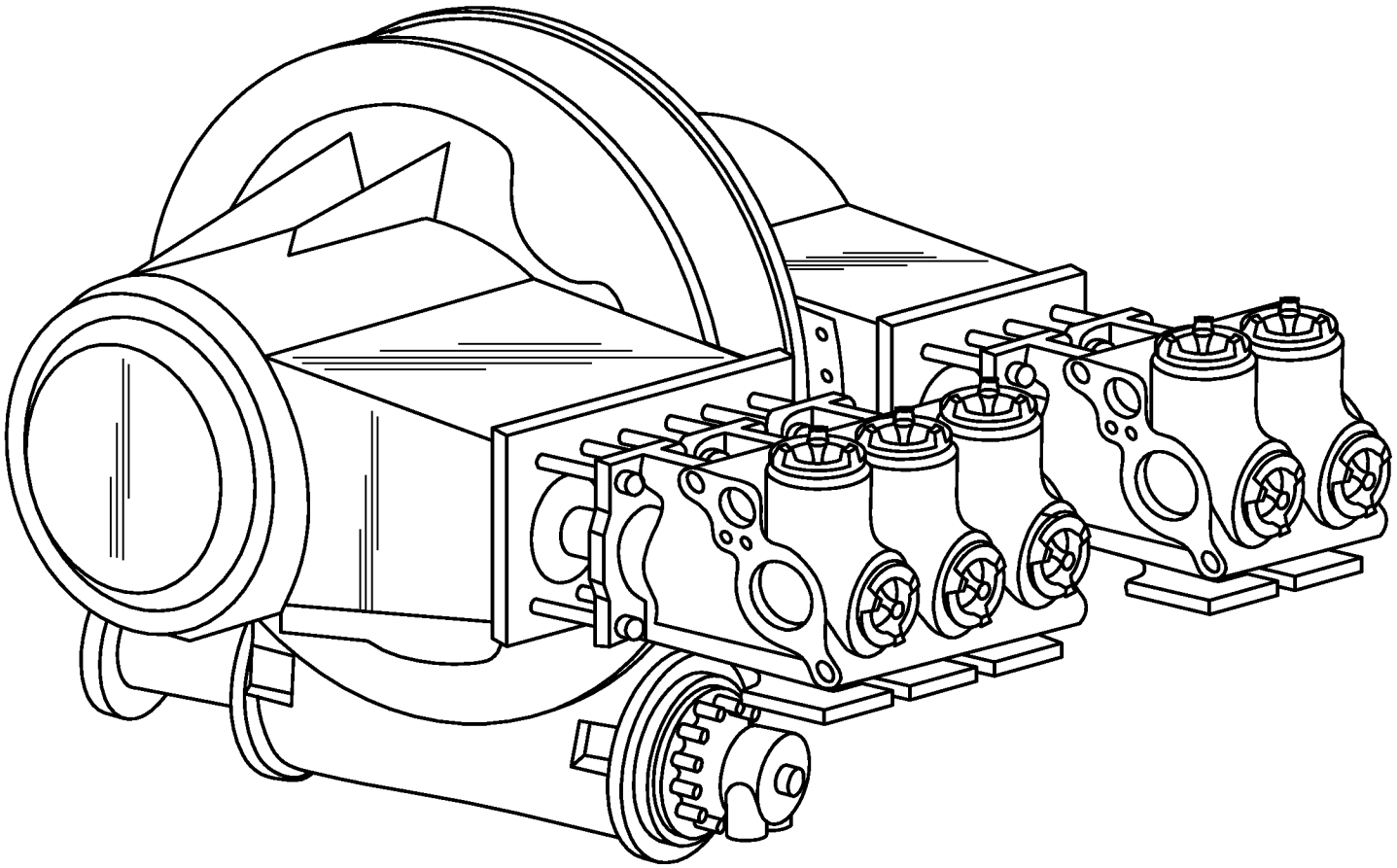
FIGS. 7-14 are illustrations of reciprocating pumps in accordance with certain embodiments of the present disclosure.
Figure 8:
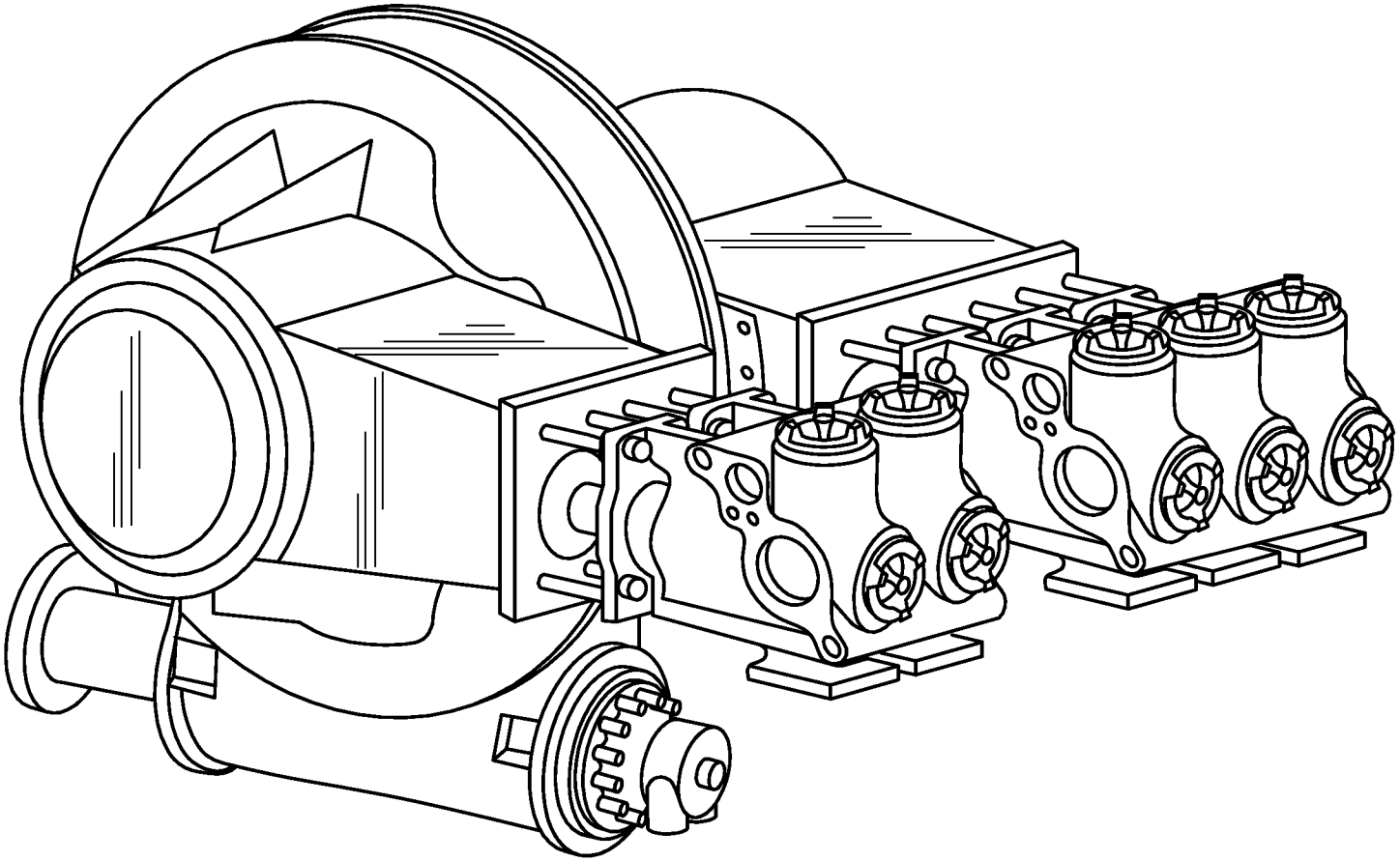
Figure 9:
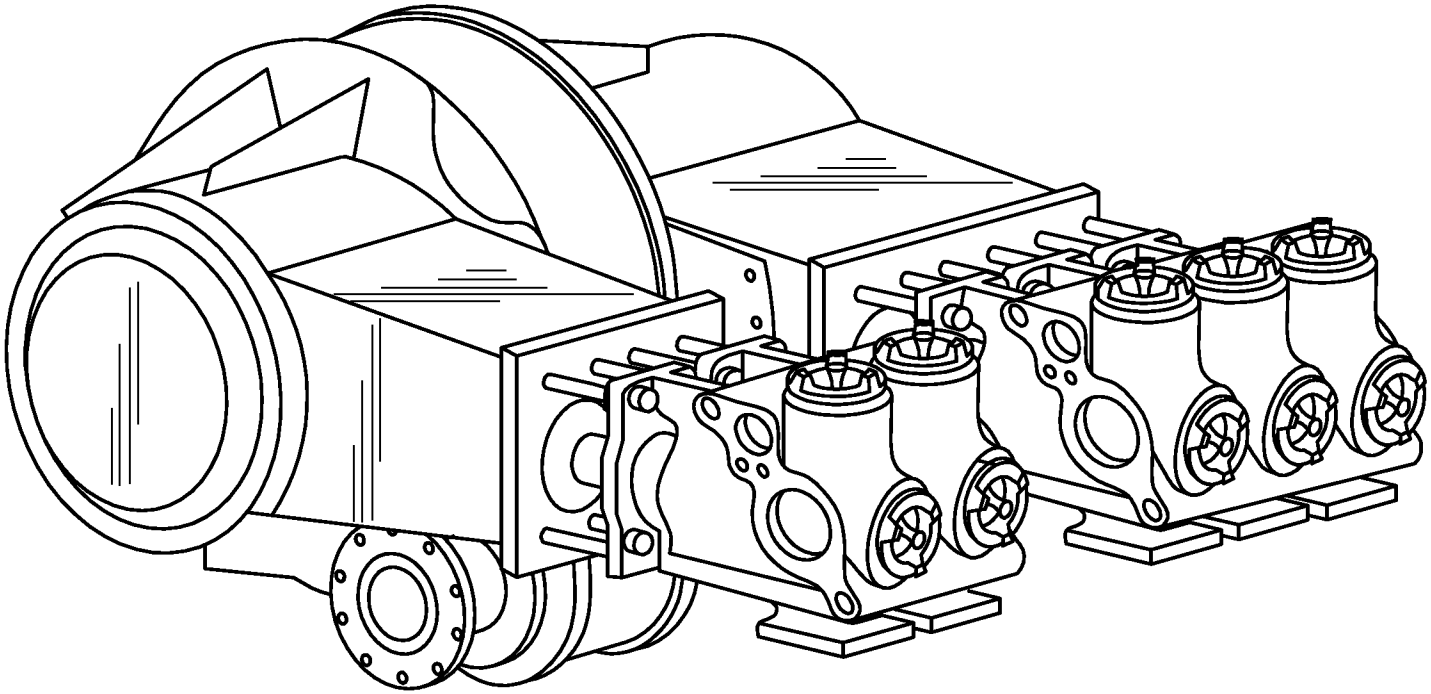
Figure 10:
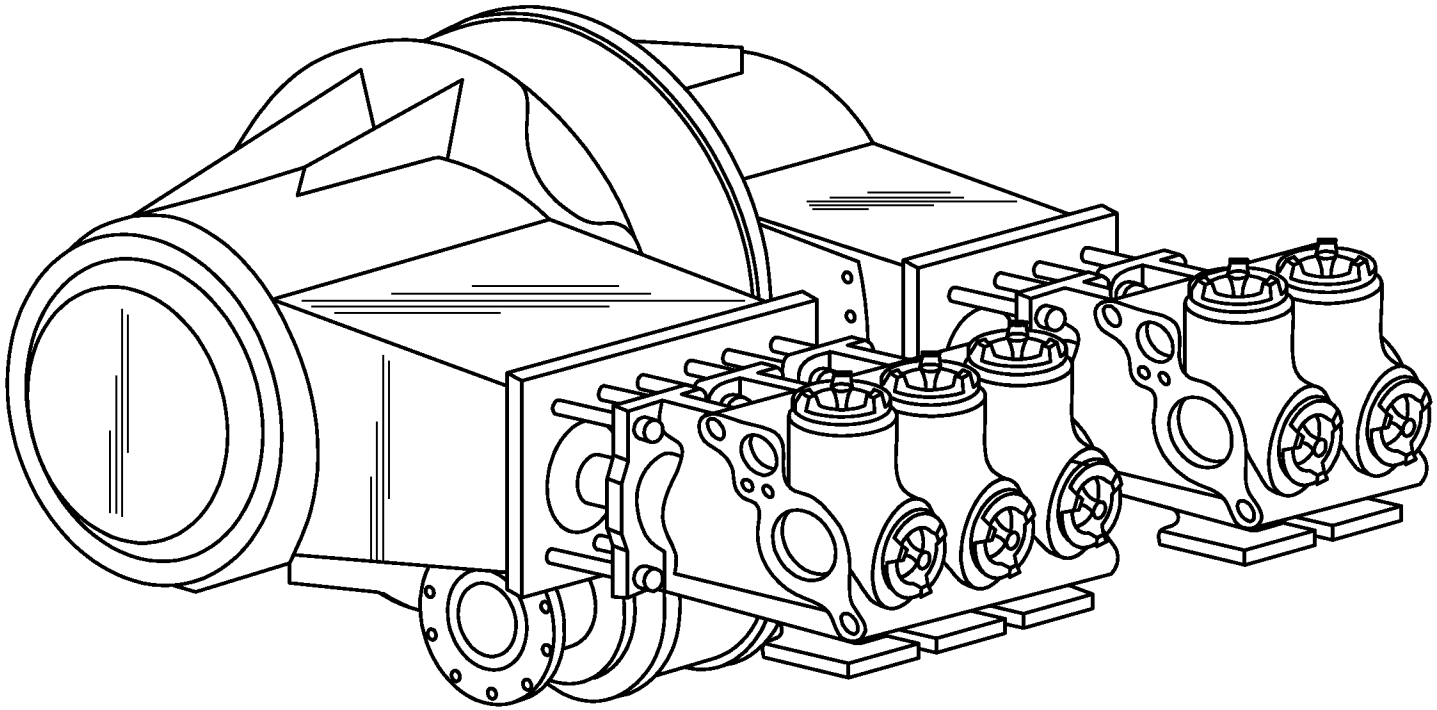
Figure 11:
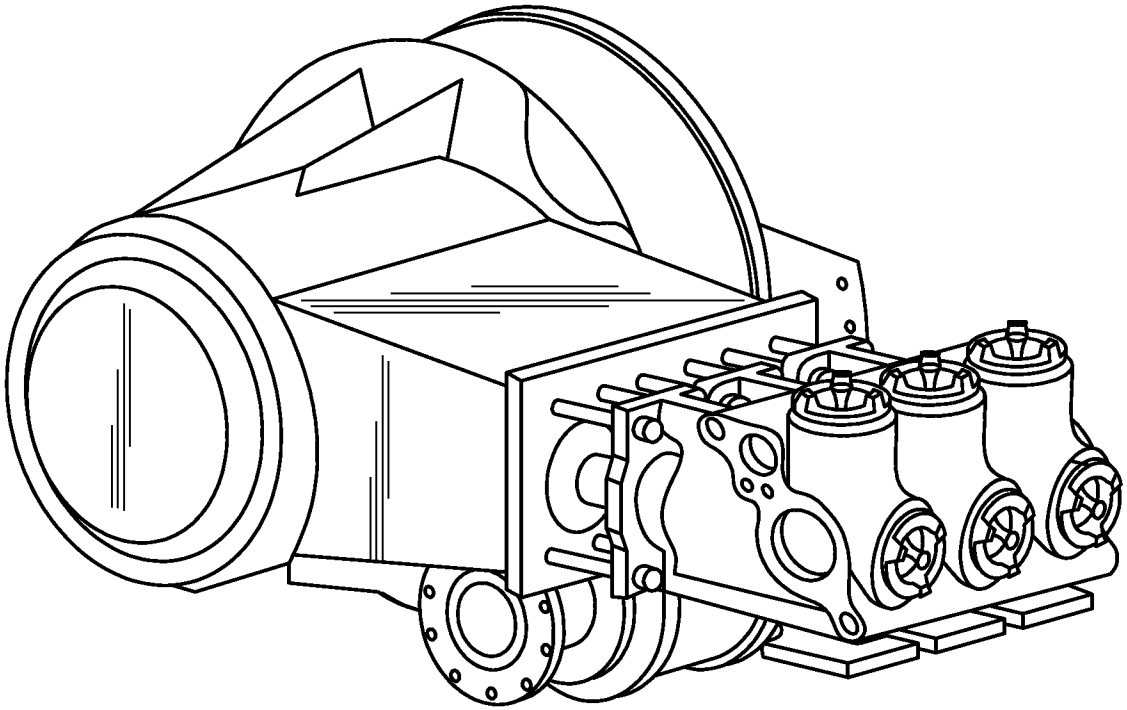
Figure 12:
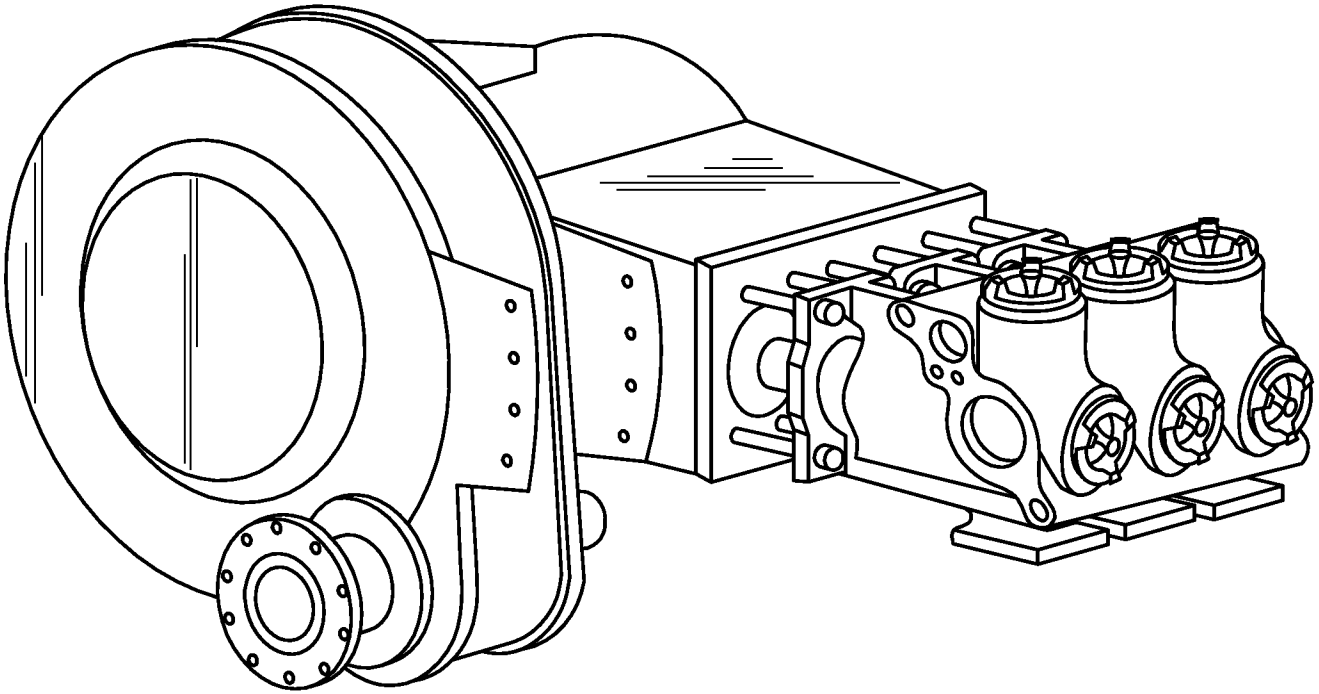
Figure 13:
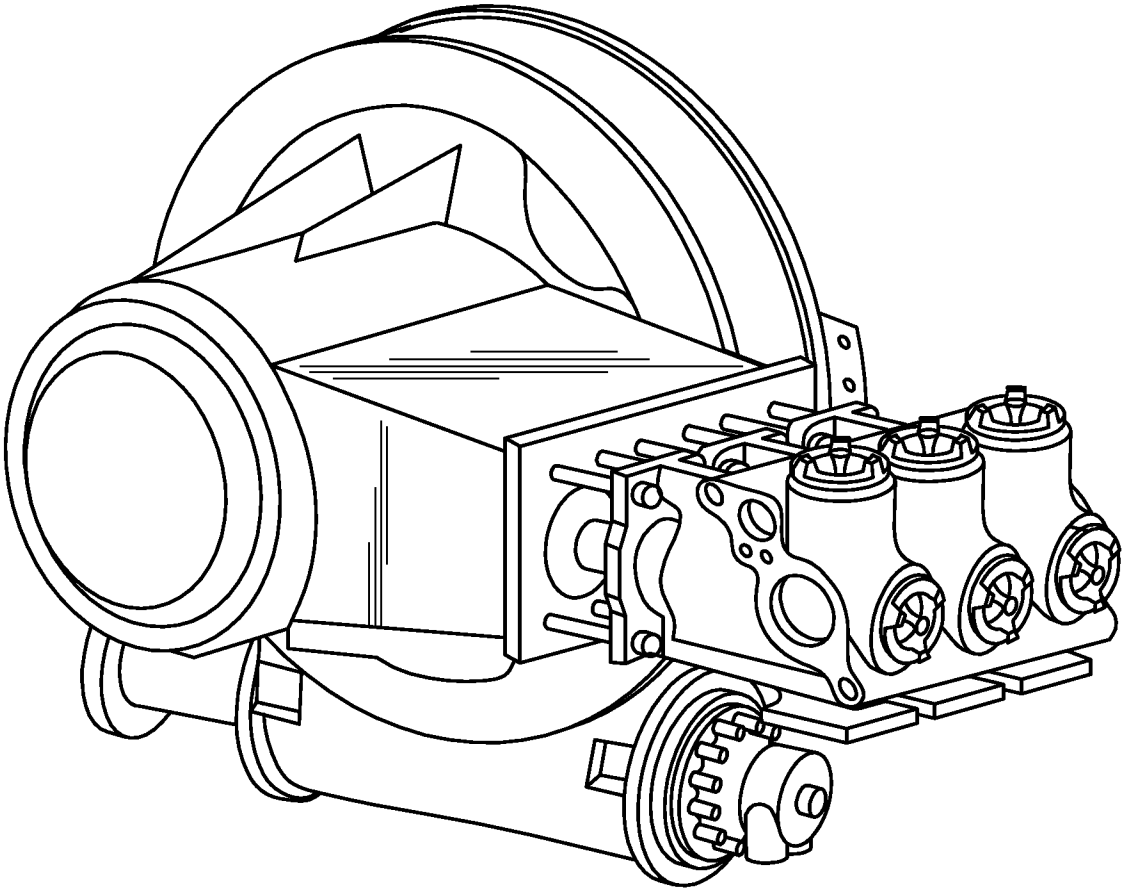
Figure 14:
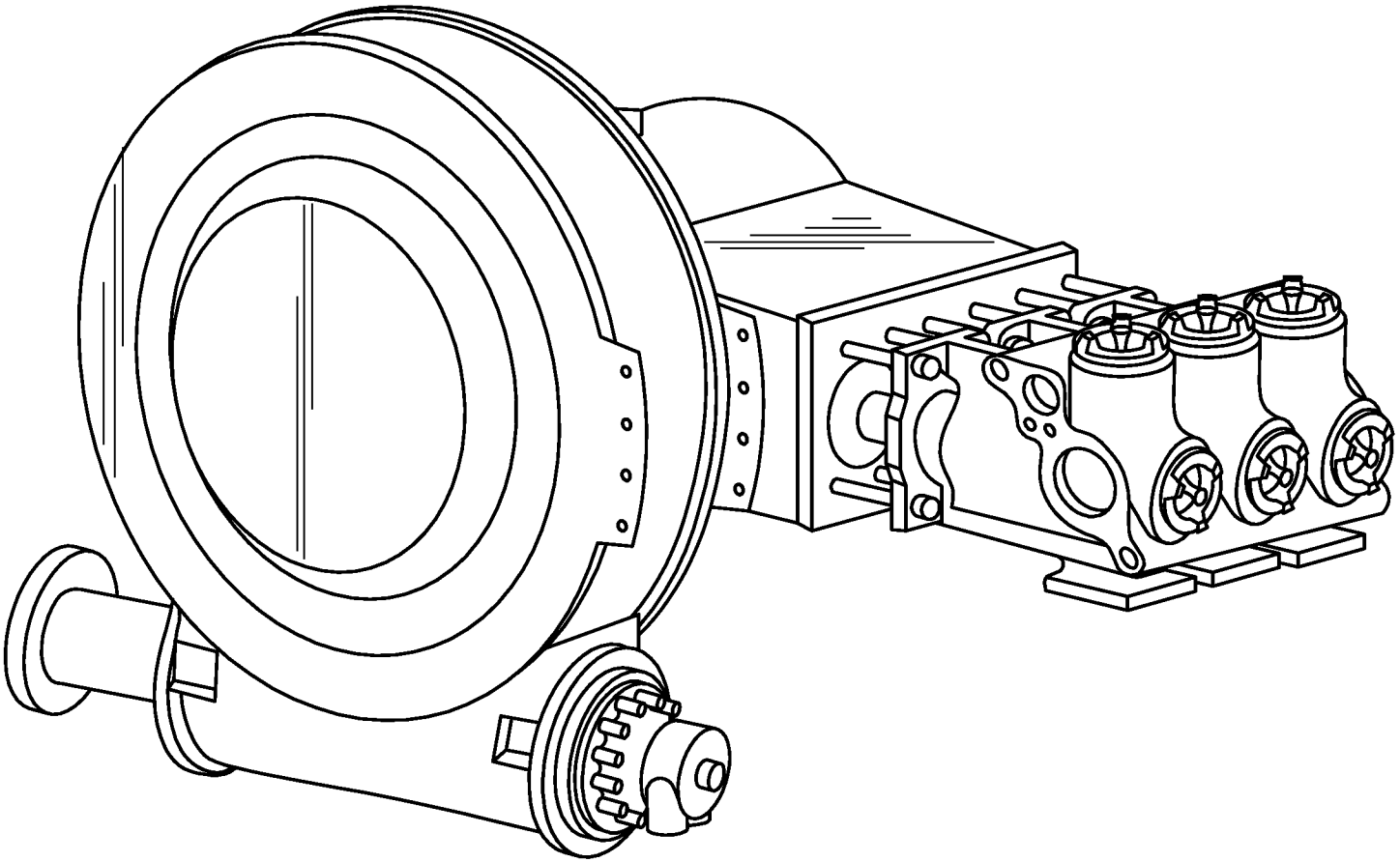

FIGS. 7-14 illustrate various possible configurations of gearboxes and crank units in accordance with certain embodiments of the present disclosure. FIGS. 7 and 8 illustrate quintuplex pump designs with worm drives in accordance to certain embodiments of the present disclosure. FIGS. 9 and 10 illustrate quintuplex pump designs with pinion drives in accordance to certain embodiments of the present disclosure. FIGS. 11 and 12 illustrate triplex pump designs with pinion drives in accordance to certain embodiments of the present disclosure. FIGS. 13 and 14 illustrate triplex pump designs with worm drives in accordance to certain embodiments of the present disclosure.

Although the present invention and its advantages have been described in detail, it should be understood that various changes, substitutions and alternations can be made herein without departing from the spirit and scope of the invention as defined by the following claims.

What is claimed is:

1. A modular pump, comprising:

a reciprocating pump, comprising:

a universal gearbox comprising a universal adapter hub having a first opening on a left side of the universal gearbox and a second opening on a right side of the universal gearbox, both openings sized to receive a crank unit attachment, wherein the first and second openings extend through opposite ends of the universal gearbox and are aligned with each other along a rotational axis of the universal adapter hub; and at least one gear that is mechanically coupled to the universal adapter hub at a location along the universal adapter hub outside of the first opening and the second opening to impart rotation to the universal adapter hub; and at least one crank unit attachment removably coupled to the universal gearbox on the right side, the left side, or both, wherein the at least one crank unit attachment comprises:

a splined hub unit extending through the first opening on the left side of the universal gearbox or the second opening on the right side of the universal gearbox; and at least two crank throws for connection to a rod and piston arrangement of the reciprocating pump;

wherein the at least one crank unit attachment is removable and interchangeable with at least one structurally different crank unit attachment having a different number of crank throws.

2. The modular pump of claim 1, wherein the universal splined hub unit of the at least one crank unit attachment is configured to rotate the at least two crank throws to operate the rod and piston arrangement in response to rotation of the universal adapter hub of the universal gearbox.

3. The modular pump of claim 1, wherein the universal gearbox further comprises a first mounting surface disposed around the universal adapter hub on the left side of the universal gearbox, and a second mounting surface disposed around the universal adapter hub on the right side of the universal gearbox.

4. The modular pump of claim 3, wherein the at least one crank unit attachment comprises a flanged housing surface for interfacing with the first mounting surface or the second mounting surface of the universal gearbox, wherein the flanged housing surface is bolted to the first mounting surface or the second mounting surface to removably couple the at least one crank unit to the universal gearbox.

5. The modular pump of claim 1, wherein the at least one crank unit attachment comprises:

a first crank unit attachment removably coupled to the universal gearbox via a central splined hub unit of the first crank unit attachment extending into and connected with the universal adapter hub on the left side of the universal gearbox, wherein the first crank unit attachment comprises at least two throws for connection to a rod and piston arrangement of the reciprocating pump; and a second crank unit attachment removably coupled to the universal gearbox via a central splined hub unit of the second crank unit attachment extending into and connected with the universal adapter hub on the right side of the universal gearbox, wherein the second crank unit attachment comprises at least two throws for connection to a rod and piston arrangement of the reciprocating pump.

6. The modular pump of claim 5, wherein the first crank unit attachment and the second crank unit attachment are structurally different crank unit attachments each having a different number of crank throws.

7. The modular pump of claim 5, wherein the first crank unit attachment and the second crank unit attachment are structurally similar crank unit attachments each having the same number of crank throws.

8. The modular pump of claim 5, wherein the first crank unit attachment is removably coupled to the universal gearbox via the central splined hub unit of the first crank unit attachment extending through the first opening on the left side of the universal gearbox and into connection with the universal adapter hub, and wherein the second crank unit attachment is removably coupled to the universal gearbox via the central splined hub unit of the second crank unit attachment extending through the second opening on the right side of the universal gearbox and into connection with the universal adapter hub.

9. The modular pump of claim 1, wherein the at least one crank unit attachment comprises a two-throw crank unit attachment.

10. The modular pump of claim 1, wherein the at least one crank unit attachment comprises a three-throw crank unit attachment.

11. The modular pump of claim 1, wherein the at least one crank unit attachment is interchangeable with at least one structurally different crank unit attachment to selectively change the modular pump between a plurality of pump configurations having a different total number of crank throws for connection to a rod and piston arrangement of the reciprocating pump.

12. The modular pump of claim 11, wherein the plurality of pump configurations comprise at least a triplex pump configuration, a quadruplex pump configuration, and a quintuplex pump configuration.

13. The modular pump of claim 1, wherein the universal gearbox further comprises a housing.

14. The modular pump of claim 13, wherein the gear comprises a gear selected from the group consisting of: a worm-style gear, an opposed helical gear, and a planetary gear.

* * * * *